US010794628B2

(12) United States Patent
Park et al.

(10) Patent No.: US 10,794,628 B2
(45) Date of Patent: Oct. 6, 2020

(54) REFRIGERATOR AND METHOD OF CONTROLLING THE SAME

(71) Applicant: Samsung Electronics Co., Ltd, Gyeonggi-do (KR)

(72) Inventors: Sang Min Park, Suwon-si (KR); Jun O Kwon, Seoul (KR); Jae Koog An, Gwangju (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 204 days.

(21) Appl. No.: 15/861,517

(22) Filed: Jan. 3, 2018

(65) Prior Publication Data

US 2018/0187964 A1 Jul. 5, 2018

(30) Foreign Application Priority Data

Jan. 3, 2017 (KR) ..... 10-2017-0000957

(51) Int. Cl.
*F25D 23/12* (2006.01)
*F25D 11/00* (2006.01)
*F25D 23/02* (2006.01)

(52) U.S. Cl.
CPC ..... *F25D 23/126* (2013.01); *F25D 11/00* (2013.01); *F25D 23/028* (2013.01); *F25D 2323/122* (2013.01)

(58) Field of Classification Search
CPC ..... F25D 23/126; F25D 11/00; F25D 23/028; F25D 2323/122
USPC ..... 62/338
See application file for complete search history.

(56) References Cited

U.S. PATENT DOCUMENTS 6,681,585 B1 * 1/2004 Stagg ..... B67D 1/0871 62/177
9,651,296 B2 5/2017 An
2009/0173152 A1 * 7/2009 Sato ..... G01F 23/268 73/304 C
2011/0162727 A1 * 7/2011 Stieb ..... F17D 5/06 137/487.5

(Continued)

FOREIGN PATENT DOCUMENTS

JP 2010096410 A 4/2010
JP 2013190116 A 9/2013

(Continued)

OTHER PUBLICATIONS

ISA/KR, "International Search Report," Application No. PCT/KR2017/015546, dated Apr. 12, 2018, 3 pages.

(Continued)

*Primary Examiner* — Steve S Tanenbaum

(57) ABSTRACT

Disclosed is a refrigerator. The refrigerator includes a body which includes a storage compartment, a door which opens and closes the storage compartment and includes a dispenser, a water tank case disposed in the door, a water tank separably mounted in the water tank case, a water level sensor configured to sense a water level inside the water tank when the water tank is mounted in the water tank case, and a water tank valve configured to guide water supplied from a water supply source to the dispenser or the water tank and to prevent water from being supplied to the water tank when the water level sensor senses that a certain amount of water is stored in the water tank.

14 Claims, 13 Drawing Sheets

(56) References Cited

U.S. PATENT DOCUMENTS

| | | | | |
|---|---|---|---|---|
| 2015/0197417 | A1* | 7/2015 | Stagg | B67D 1/0005 141/1 |
| 2015/0329347 | A1* | 11/2015 | Veldhi | B67D 3/0003 141/1 |

FOREIGN PATENT DOCUMENTS

| | | | |
|---|---|---|---|
| KR | 10-2006-0027466 | A | 3/2006 |
| KR | 10-2006-0091058 | A | 8/2006 |
| KR | 10-2009-0020951 | A | 2/2009 |
| KR | 10-2012-0007198 | A | 1/2012 |
| KR | 10-2013-0014013 | A | 2/2013 |
| KR | 10-2013-0061430 | A | 6/2013 |
| KR | 10-2014-0059986 | A | 6/2013 |
| KR | 10-1276315 | B1 | 6/2013 |
| KR | 10-2015-0005342 | A | 1/2015 |
| KR | 10-2016-0012693 | A | 2/2016 |

OTHER PUBLICATIONS

Intellectual Property India, "Examination report under sections 12 & 13 of the Patents Act, 1970 and the Patents Rules, 2003," Application No. IN 201817032491, dated Nov. 4, 2019, 6 pages.

* cited by examiner

REFRIGERATOR AND METHOD OF CONTROLLING THE SAME

CROSS-REFERENCE TO RELATED APPLICATION

This application is related to and claims priority to Korean Patent Application No. 10-2017-0000957 filed on Jan. 3, 2017, the disclosure of which is incorporated herein by reference.

TECHNICAL FIELD

Embodiments of the present disclosure relate to a refrigerator and a method of controlling the same, and more particularly, to a refrigerator capable of automatically supplying water to a water tank detachably provided at the refrigerator and a method of controlling the refrigerator.

BACKGROUND

Generally, a refrigerator is a home appliance which includes a storage compartment and a cold air supply and stores food in a fresh state. Such a refrigerator may include a dispenser configured to allow a user to get ice or water from an exterior of the refrigerator without opening a door and include an ice-making chamber which makes ice to be provided to the user through the dispenser.

Such a general refrigerator may supply water, cooled by cold air of a storage compartment, to a user through a dispenser. However, when the user needs a large amount of water at once, since the user has to wait until water supplied from the dispenser has been collected in a container, it is inconvenient to use this water.

Also, even when a water tank capable of storing water is separately provided in the storage compartment, since the user should directly fill the water tank with water, it is also inconvenient to use water.

SUMMARY

To address the above-discussed deficiencies, it is a primary object to provide a refrigerator capable of increasing user convenience in using water and a method of controlling the refrigerator.

It is another aspect of the present disclosure to provide a refrigerator capable of automatically supplying a certain amount of water to a water tank provided in a storage compartment and a method of controlling the refrigerator.

It is still another aspect of the present disclosure to provide a refrigerator capable of allowing a water tank provided in a storage compartment to constantly store a certain amount of water and a method of controlling the refrigerator.

Additional aspects of the present disclosure will be set forth in part in the description which follows and, in part, will be obvious from the description, or may be learned by practice of the present disclosure.

In accordance with one aspect of the present disclosure, a refrigerator includes a body including a storage compartment, a door that opens or closes the storage compartment and includes a dispenser, a water tank case disposed in the door, a water tank separably mounted in the water tank case, a water level sensor configured to sense a water level inside the water tank when the water tank is mounted in the water tank case, and a water tank valve configured to guide water supplied from a water supply source to the dispenser or the water tank and to prevent water from being supplied to the water tank when the water level sensor senses that a certain amount of water is stored in the water tank.

The water tank case may include a first support that supports a portion of the water tank in a direction in that the water tank is mounted in the water tank case.

The water tank case may include a second support that supports another portion of the water tank in a direction opposite to a pivoting direction to prevent the water tank from pivoting on the portion of the water tank supported by the first support when the door closes.

The first support may be provided to cover at least a portion of a bottom end of the water tank.

The water tank case may be separably mounted in the door.

The water level sensor may be configured to sense the water level inside the water tank by sensing a capacitance change according to a water level of a liquid in the water tank.

The water level sensor may include a sensor that comes into contact with the water tank when the water tank is mounted in the water tank case and an elastic member that pressurizes the sensor in a direction opposite to a direction in which the water tank is mounted.

The refrigerator may further include a water purifying filter disposed in a flow path between the water supply source and the water tank valve and configured to purify water supplied from the water supply source.

The water tank valve may be configured to supply water to the water tank when the water level sensor senses that a certain amount of water is not present in the water tank.

The dispenser may include an operating lever exposed to an outside of the door, and the water tank valve may be configured to supply the water through the dispenser by opening a flow path that faces the dispenser when a signal is input to the operating lever.

The water tank case may include a leaked water tray provided below the water tank case and a water leak sensor configured to sense water collected in the leaked water tray, and the water tank valve may be configured to cut off a water supply to the water tank when the water leak sensor senses that a certain amount of water has been collected in the leaked water tray.

The water tank valve may be disposed at a top of the water tank case such that an outlet hole through that water supplied to the water tank is discharged faces downward. Also, the water tank may include a body, a cover that covers a top of the body, and a water tank inlet hole formed at a top surface of the cover and disposed at a position corresponding to the outlet hole when the water tank is mounted in the water tank case.

The water tank inlet hole may have a size greater than that of the outlet hole.

The water tank may include a body, a cover that covers a top of the body, and an infuser separably coupled to the cover and disposed in the body when the cover is coupled to the body.

The water tank case may include a water tank sensor configured to sense whether the water tank is mounted.

In accordance with another aspect of the present disclosure, a refrigerator includes a body including a storage compartment, a door that opens or closes the storage compartment, a water tank case disposed at the door, a water tank separably mounted in the water tank case, a water level sensor configured to sense a water level inside the water tank when the water tank is mounted in the door, and a water tank valve configured to open or close a flow path that faces the water tank depending on the water level inside the water tank sensed by the water level sensor. Here, the water tank case covers at least a portion of a bottom end of the water tank.

The water tank may include a body, a cover that covers a top of the body, and a sealing member that seals a space between the body and the cover.

In accordance with still another aspect of the present disclosure, a method of controlling a refrigerator includes sensing a water level of a water tank separably mounted in a water tank case provided at a door of the refrigerator, selectively supplying water to the water tank based on a water level of the water tank that is sensed by a water level sensor, and cutting off a water supply to the water tank when the water level sensor senses that a certain amount of water is stored in the water tank.

The method may further include cutting off the water supply to the water tank when the water tank is not mounted in the water tank case.

The method may further include cutting off the water supply to the water tank when a certain amount of water has been collected in a leaked water tray provided below the water tank case.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
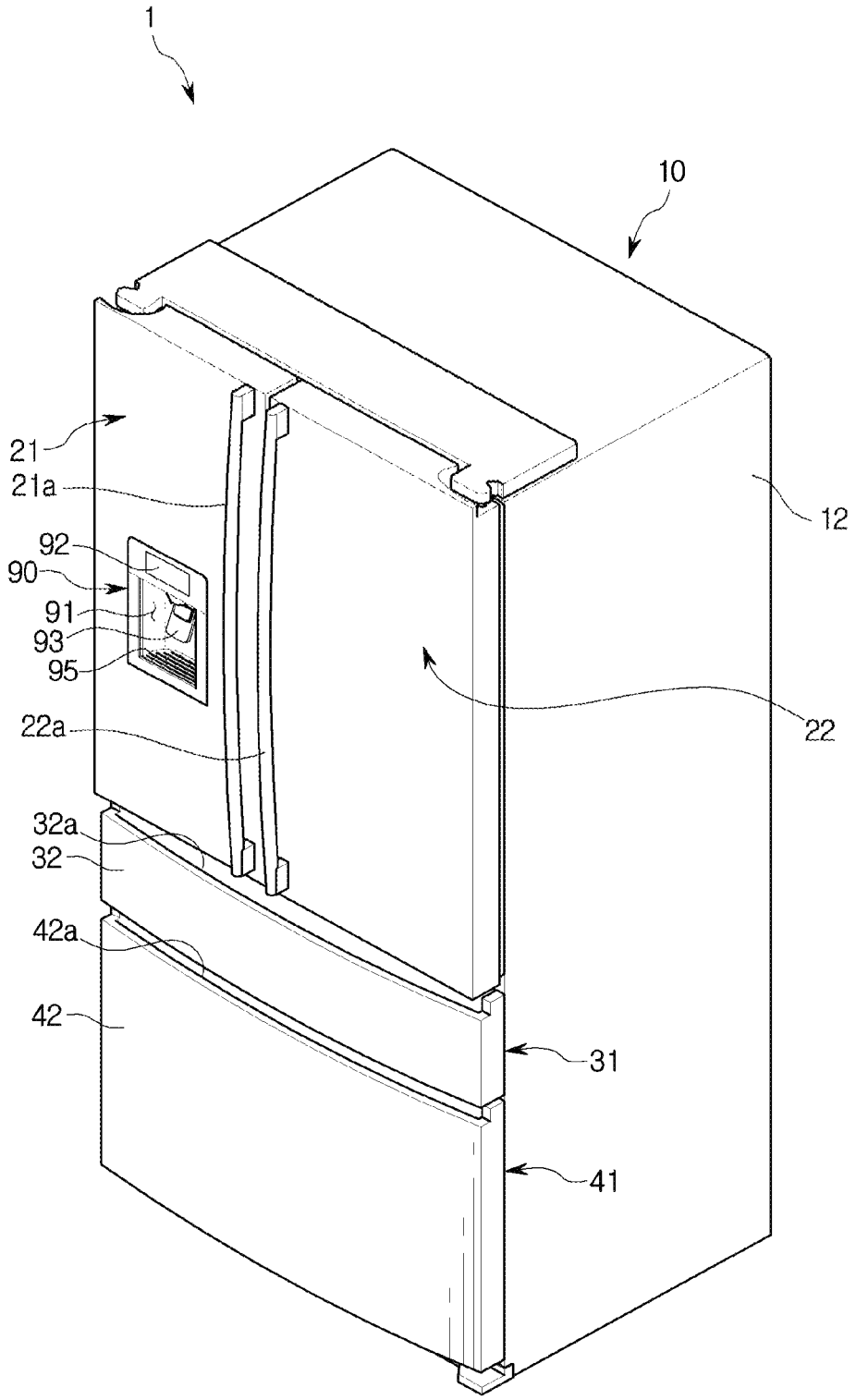
FIG. 1 is a view illustrating an exterior of a refrigerator according to one embodiment of the present disclosure.

FIGS. 1 through 12, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Embodiments disclosed in the specification and components shown in the drawings are merely preferable examples of the present disclosure and various modifications capable of replacing the embodiments and drawings of the specification may be made at the time of filing the present application.

Also, throughout the drawings of the present specification, like reference numerals or symbols refer to components or elements configured to perform substantially identical functions.

Also, the terms used herein are intended to explain the embodiments but are not intended to limit and/or define the present disclosure. Singular forms, unless defined otherwise in context, include plural forms. Throughout the specification, the terms "comprise", "have", and the like are used herein to specify the presence of stated features, numbers, steps, operations, elements, components or combinations thereof but do not preclude the presence or addition of one or more other features, numbers, steps, operations, elements, components, or combinations thereof.

Also, even though the terms including ordinals such as first, second and the like may be used for describing various components, the components will not be limited by the terms and the terms are used only for distinguishing one component from others. For example, without departing from the scope of the present disclosure, a first component may be referred to as a second component, and similarly, the second component may be referred to as the first component. The term "and/or" includes any and all combinations or one of a plurality of associated listed items.

Meanwhile, the terms "frontward", "rearward", "above", "below", "a top end", "a bottom end", and the like used below are defined on the basis of the drawings, and shapes and positions of components are not limited thereto.

Hereinafter, the embodiments will be described in detail with reference to the attached drawings.

Figure 2:
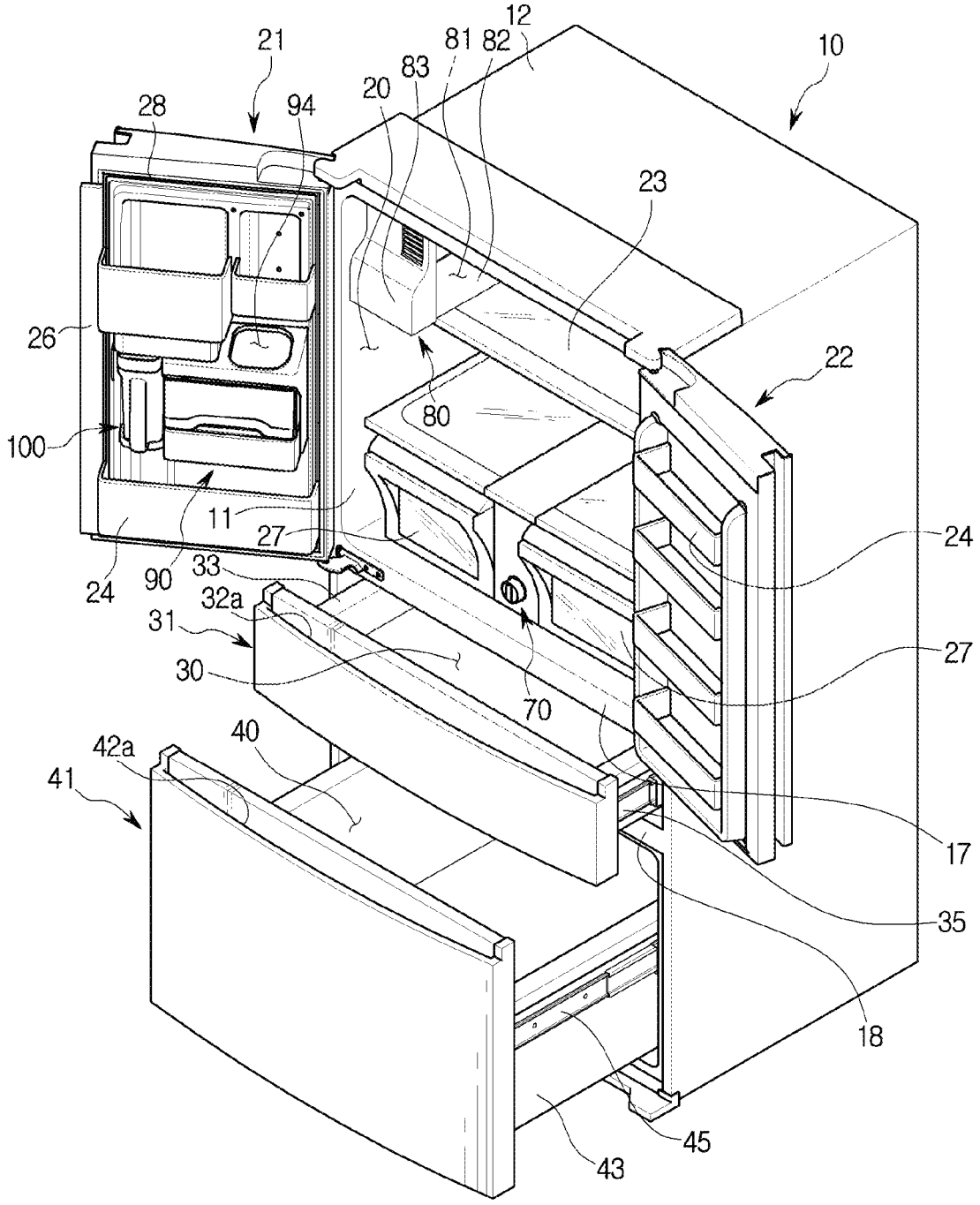
FIG. 2 is a view illustrating a state in which doors of the refrigerator of FIG. 1 have been opened.
Figure 3:
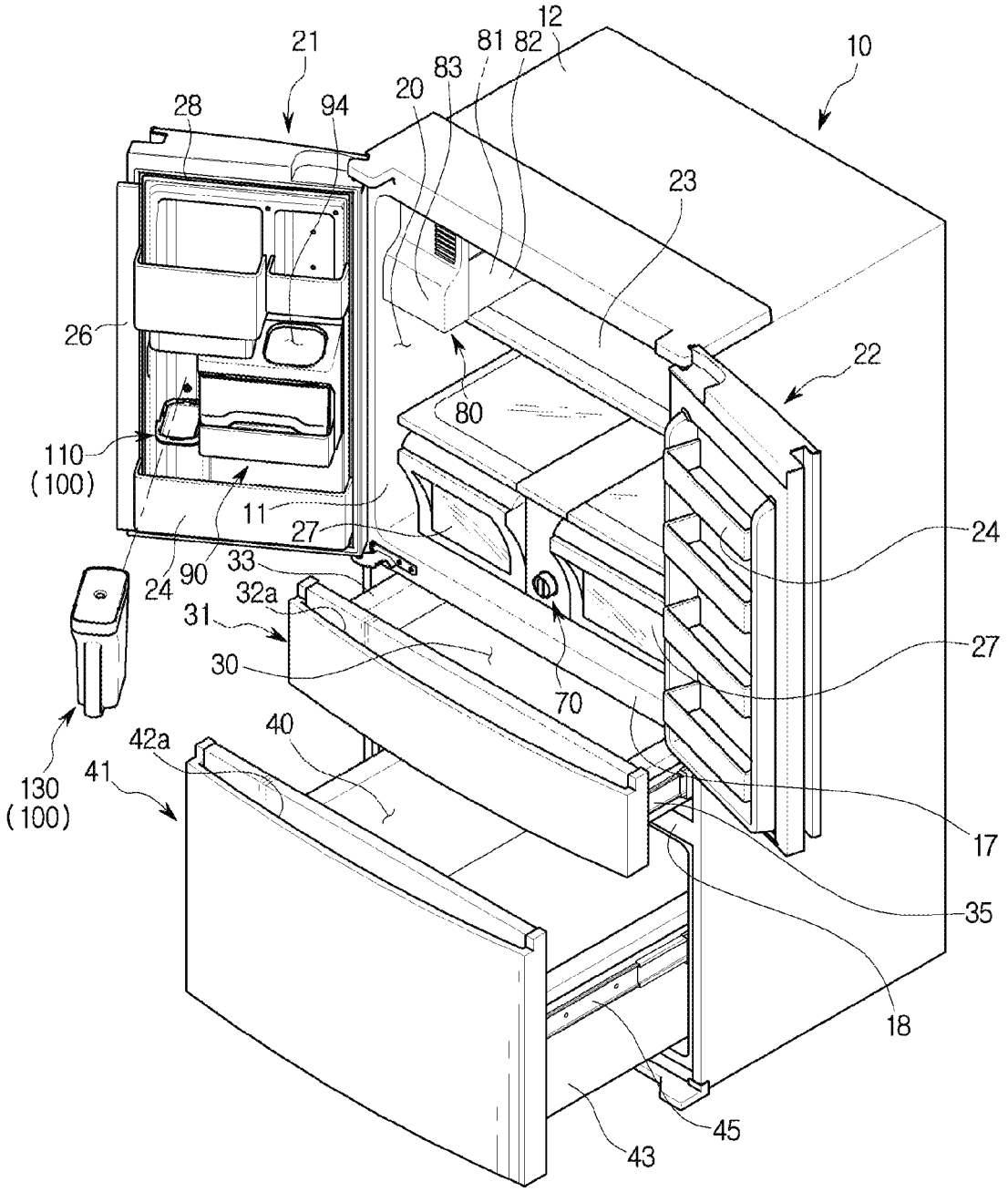
FIG. 3 is a view illustrating a state in which a water tank shown in FIG. 2 has been separated from the door.
Figure 4:
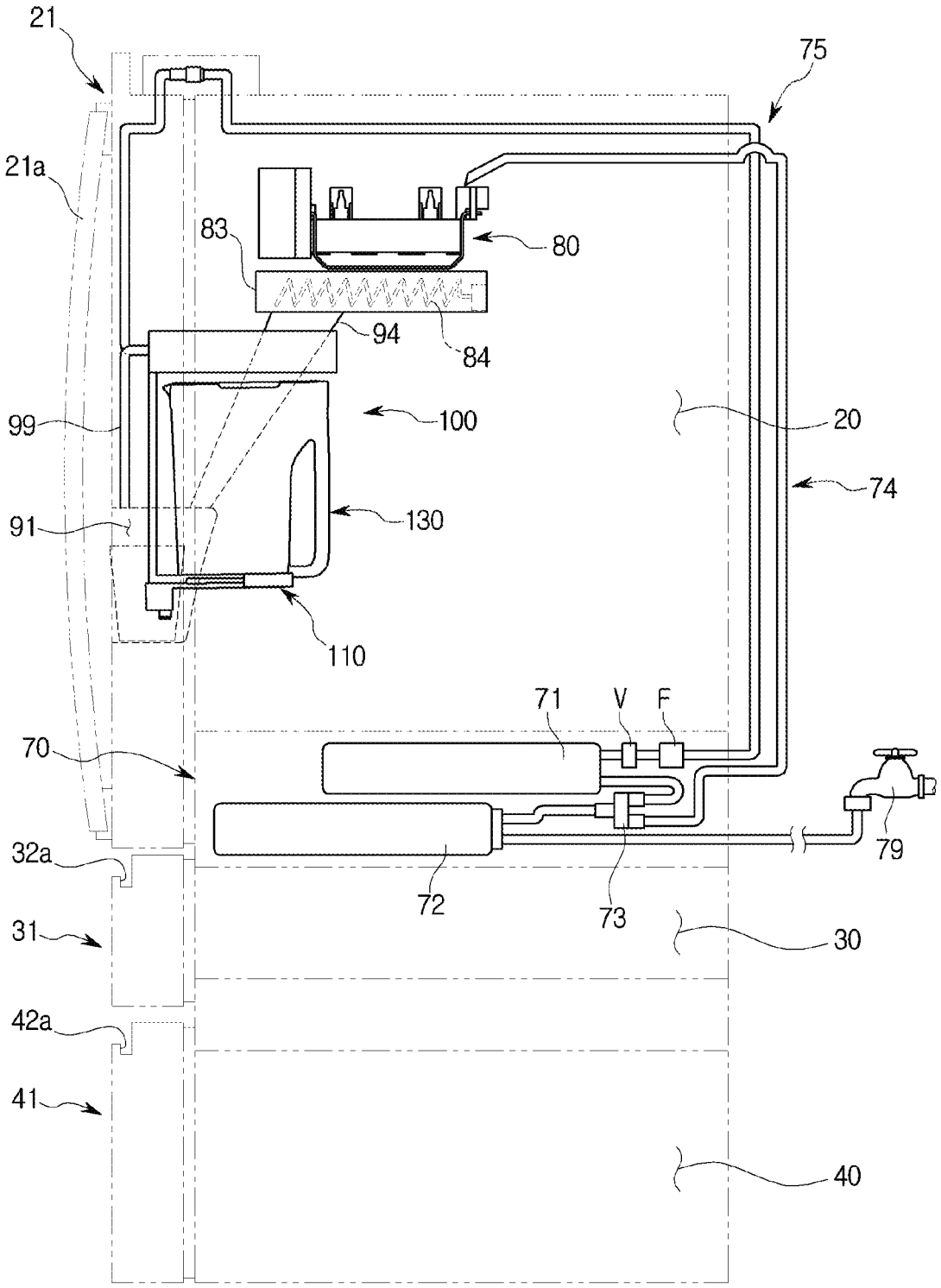
FIG. 4 is a schematic side cross-sectional view of the refrigerator shown in FIG. 1.

FIG. 1 is a view illustrating an exterior of a refrigerator 1 according to one embodiment of the present disclosure. FIG. 2 is a view illustrating a state in which doors 21 and 22 of the refrigerator 1 of FIG. 1 have been opened. FIG. 3 is a view illustrating a state in which a water tank 120 shown in FIG. 2 has been separated from the door 21. FIG. 4 is a schematic side cross-sectional view of the refrigerator 1 shown in FIG. 1.

Referring to FIGS. 1 to 4, the refrigerator 1 according to one embodiment of the present disclosure may include a body 10, storage compartments 20, 30, and 40 formed in the body 10, doors 21, 22, 31, and 41 provided to open the storage compartments 20, 30, and 40, and a cold air supplier which supplies cold air to the storage compartments 20, 30, and 40.

The cold air supplier may include an evaporator, a compressor, a condenser, an expander, and the like to cyclically perform evaporation and compression of a refrigerant.

The body 10 may include an inner casing 11 which forms the storage compartments 20, 30, and 40, an outer casing 12 which is coupled to an outside of the inner casing 11, and an insulator (not shown) provided between the inner casing 11 and the outer casing 12.

The inner casing 11 may be formed by injection-molding a plastic material, and the outer casing 12 may be formed of a metal material. A urethane foam insulation may be used as the insulator, and a vacuum insulation panel may be used therewith as necessary. The urethane foam insulation may be formed by filling, with foam urethane formed by mixing urethane and foam and allowing them to foam, a space between the inner casing 11 and the outer casing 12 coupled to each other. The foam urethane may have strong adhesion to strengthen a coupling force between the inner casing 11 and the outer casing 12 and may have adequate strength when foaming is completed.

The body 10 may include a first middle wall 17 and a second middle wall 18 which divide the storage compartments 20, 30, and 40. The first middle wall 17 may divide the refrigerator compartment 20 and freezer compartments 30 and 40. The second middle wall 18 may divide the freezer compartments 30 and 40 into a first freezer compartment 30 and a second freezer compartment 40.

Meanwhile, the type of division of the storage compartments 20, 30, and 40 is not limited to the horizontal type shown in FIG. 2 and may be configured to be the vertical type and the like and may be embodied in a variety of well-known shapes.

The storage compartments 20, 30, and 40 may include the refrigerator compartment 20 formed on an upper side of the body 10 and the freezer compartments 30 and 40 formed on a lower side of the body 10. The freezer compartments 30 and 40 may include the first freezer compartment 30 provided below the refrigerator compartment 20 and the second freezer compartment 40 provided below the first freezer compartment 30. The refrigerator compartment 20 may remain at a temperature of approximately 0 to 5° C. to keep food refrigerated. The freezer compartments 30 and 40 may remain at a temperature of approximately −30 to 0° C. to keep food frozen.

In the refrigerator compartment 20, a rack 23 capable of disposing food thereon and storage containers 27 capable of storing food may be provided.

The refrigerator compartment 20, the first freezer compartment 30, and the second freezer compartment 40 may have open fronts for inserting or withdrawing food. The open front of the refrigerator compartment 20 may be opened and closed by a pair of pivotable doors 21 and 22 coupled to the body 10 using hinges. The open front of the first freezer compartment 30 and the open front of the second freezer compartment 40 may be opened and closed by sliding doors 31 and 41, respectively, which slidably move with respect to the body 10. Door guards 24 capable of storing food may be provided at rear sides of the refrigerator compartment doors 21 and 22.

Gaskets 28 which keep cold air in the refrigerator compartment 20 by sealing spaces between the body 10 and the refrigerator compartment doors 21 and 22 when the refrigerator compartment doors 21 and 22 are closed may be provided at edge portions of the rear sides of the refrigerator compartment doors 21 and 22. Also, the first refrigerator compartment door 21 of the refrigerator compartment doors 21 and 22 may include a pivotable bar 26 which keeps the cold air in the refrigerator compartment 20 by sealing a space between the first refrigerator compartment door 21 and the second refrigerator compartment door 2 when the refrigerator compartment doors 21 and 22 are closed.

The refrigerator compartment doors 21 and 22 may include handles 21*a* and 22*a* provided to be gripped by a user so that the user may easily open and close the refrigerator compartment doors 21 and 22. The handles 21*a* and 22*a* may be provided lengthwise along a vertical direction.

The first refrigerator compartment door 21 of the refrigerator compartment doors 21 and 22 may include a dispenser 90 to allow water or ice to be dispensed from the exterior of the body 10 without opening the first refrigerator compartment door 21.

The dispenser 90 may include a water dispensing space 91 in which water or ice may be dispensed by inserting a container such as a cup thereinto, a control panel 92 on which input buttons for manipulating a variety of settings of the dispenser 90 and a display which displays a variety of pieces of information of the dispenser 90 are provided, and an operating lever 93 for operating the dispenser 90 so that the dispenser 90 to dispenses water or ice. The operating lever 93 may be exposed to the outside of the door 21. The refrigerator 1 may not only dispense ice and/or water just by operation of the operating lever 93, but may also dispense ice and/or water by receiving a supply command through the control panel 92.

The control panel 92 may be embodied as a display. Here, the display may be embodied as a variety of types of well-known displays such as a liquid crystal display (LCD), a light emitting diode (LED) display, a plasma display panel (PDP), an organic LED (OLED) display, a cathode ray tube (CRT) display, and the like but is not limited thereto, and includes all apparatuses capable of visually displaying a variety of pieces of information related to the refrigerator 1 and displaying a user interface capable of receiving a variety of control commands from the user. The refrigerator 1 may display on the control panel 92 a user interface embodied not only to provide a variety of pieces of information to the user but also to receive a variety of control commands.

The dispenser 90 may include a chute 94 which connects an ice maker 80 to the water dispensing space 91 to dispense ice made in the ice maker 80 into the water dispensing space 91.

Also, the dispenser 90 may include a container support 95 which supports the container which stores water or ice. The container support 95 may be provided to be fixed to a particular position. The container support 95 may be embodied to be vertically and horizontally movable. For example, when the container is disposed on the container support 95, the refrigerator 1 moves the container support 95 to a position adjacent to an outlet by controlling a motor included in the container support 95 such that it is possible to prevent water or ice from being scattered outward from the container when the water or ice is dispensed.

Also, the container support 95 may prevent the container from deviating from the container support 95 by fixing the container positioned on the container support 95. For example, a groove which allows the container to be disposed on the container support 95 may be provided at a top surface of the container support 95 and may be embodied using an elastic member. Accordingly, a user inserts the container in the groove such that the container may be fixed.

The container support 95 may include the motor as described above. Accordingly, when it is sensed that the container is positioned at the groove at the container support 95, the refrigerator 1 may adjust a configuration of the container support 95 to fix the container in the groove using the motor.

The sliding doors 31 and 41 may include door portions 32 and 42 which cover the open fronts of the freezer compartments 30 and 40 and baskets 33 and 43 coupled to rear surfaces of the door portions 32 and 42. The baskets 33 and 43 may be slidably supported by rails 35 and 45. The door portions 32 and 42 may include handles 32*a* and 42*a*.

An ice making chamber 81 capable of manufacturing ice may be formed at a top of the refrigerator compartment 20 and separated from the refrigerator compartment 20 by an ice making chamber wall 82. The ice maker 80 which makes ice, an ice bucket 83 which stores ice made by the ice maker 80, and an auger 84 which transfers the ice stored in the ice bucket 83 to the chute 94 may be provided in the ice making chamber 81.

A storage tank assembly 70 capable of storing water may be provided in the refrigerator compartment 20. The storage tank assembly 70 may include a storage tank 71 and a water purifying filter 72. The storage tank assembly 70, as shown in FIG. 2, may be disposed between a plurality of storage containers 27. A position of the storage tank assembly 70 is not limited thereto, and the storage tank assembly 70 only has to be disposed in the refrigerator compartment 20 to cool water in the storage tank 71 of the storage tank assembly using cold air in the refrigerator compartment 20.

The storage tank 71 may be connected to an external water supply source 79 such as a water supply and may store water purified by the water purifying filter 72. A valve (not shown) for adjusting water supplied to the external water supply source 79 may be provided at a hose which connects the external water supply source 79 to the storage tank 71.

The water purifying filter 72 may be disposed in a flow path between the external water supply source 79 and a water tank valve 121 of a water tank assembly 100 which will be described below. The water purifying filter 72 may purify water supplied from the external water supply source 79.

The storage tank assembly 70 may include a three-way valve which connects the water purifying filter 72, the storage tank 71, and the ice maker 80 to one another. The three-way valve 73 may selectively supply water purified by the water purifying filter 72 to the storage tank 71 and the ice maker 80. A position of the three-way valve 73 is not limited thereto and may be provided at a position by which the water purified by the water purifying filter 72 is stored in the storage tank 71 and the water of the storage tank 71 is selectively suppliable to the ice maker 80 and the water tank assembly 100.

Meanwhile, a water valve V may be provided at a water supply hose which connects the storage tank 71 to the water tank assembly 100. Accordingly, the refrigerator 1 according to one embodiment of the present disclosure may adjust an amount of water supplied which passes through the flow path and is supplied through the water tank assembly 100 by adjusting an opening rate of the water valve V. Also, a flow sensor F may be provided at the water supply hose and may measure the amount of water supplied to the water tank assembly 100.

The refrigerator 1 may include an ice making water supply flow path 74 which connects the external water supply source 79 to the ice maker 80 to supply water to the ice maker 80. The water of the external water supply source 79 may be supplied to the ice maker 80 by a water pressure of the external water supply source 79 under the control of the three-way valve 73. The ice making water supply flow path 74 may be provided to pass through the water purifying filter 72. Accordingly, the water of the external water supply source 79 may be purified by passing through the water purifying filter 72 and may be supplied to the ice maker 80.

Since the water supplied to the ice maker 80, even though not cooled by the storage tank 71, is cooled at the ice maker 80, the ice making water supply flow path 74 may not pass through the storage tank 71. However, unlike the embodiment shown in FIG. 4, the ice making water supply flow path 74 may be configured to pass through the storage tank 71. In this case, since water cooled in the storage tank 71 is supplied to the ice maker 80, energy consumed by the ice maker 80 may be reduced.

The refrigerator 1 may include a water tank water supply flow path 75 which connects the external water supply source 79 to the water tank assembly 100 to supply water to the water tank assembly 100. The water of the external water supply source 79 may be supplied to the water tank assembly 100 by a water pressure of the external water supply source 79 under the control of the three-way valve 73. The water tank water supply flow path 75 may be provided to pass through the water purifying filter 72. Accordingly, the water of the external water supply source 79 may be purified by passing through the water purifying filter 72 and may be supplied to the water tank assembly 100.

In addition, the water tank water supply flow path 75 may be provided to pass through the storage tank 71. Accordingly, the water of the external water supply source 79 may be cooled in the storage tank 71 and then may be supplied to the water tank assembly 100.

Figure 5:
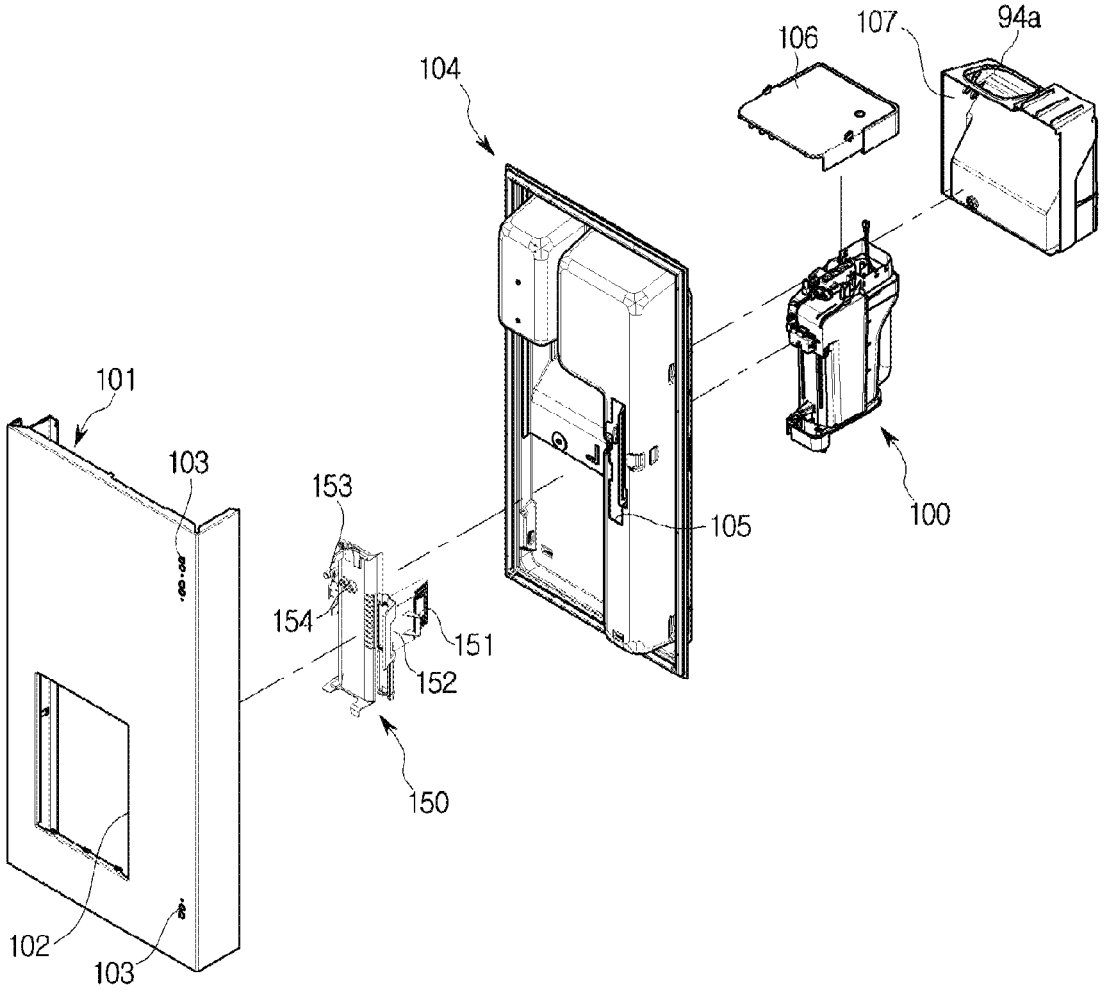
FIG. 5 is an exploded view illustrating a water tank assembly and one of the doors of the refrigerator shown in FIG. 1.
Figure 6:
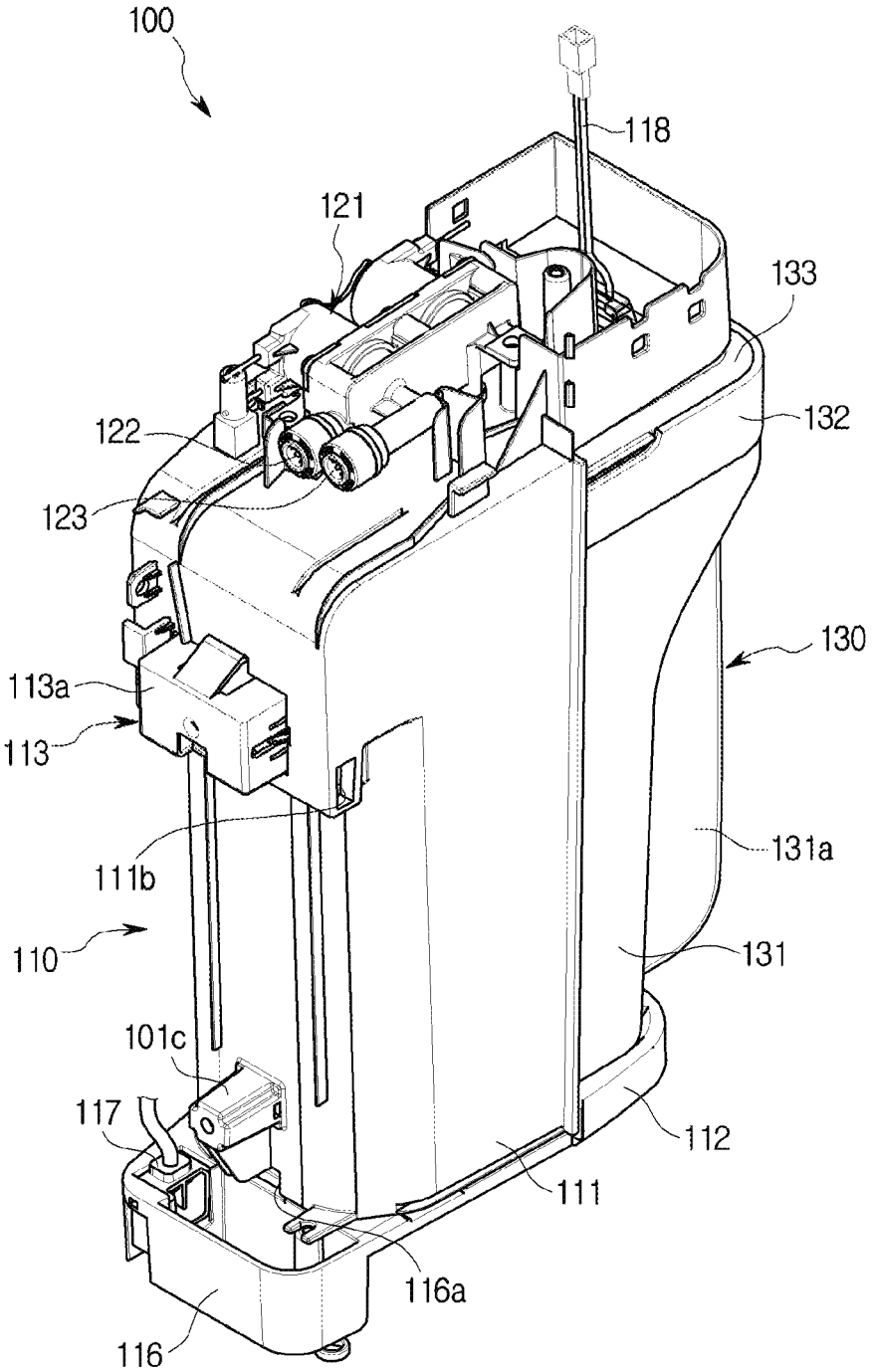
FIG. 6 is a view illustrating the water tank assembly shown in FIG. 5.
Figure 7:
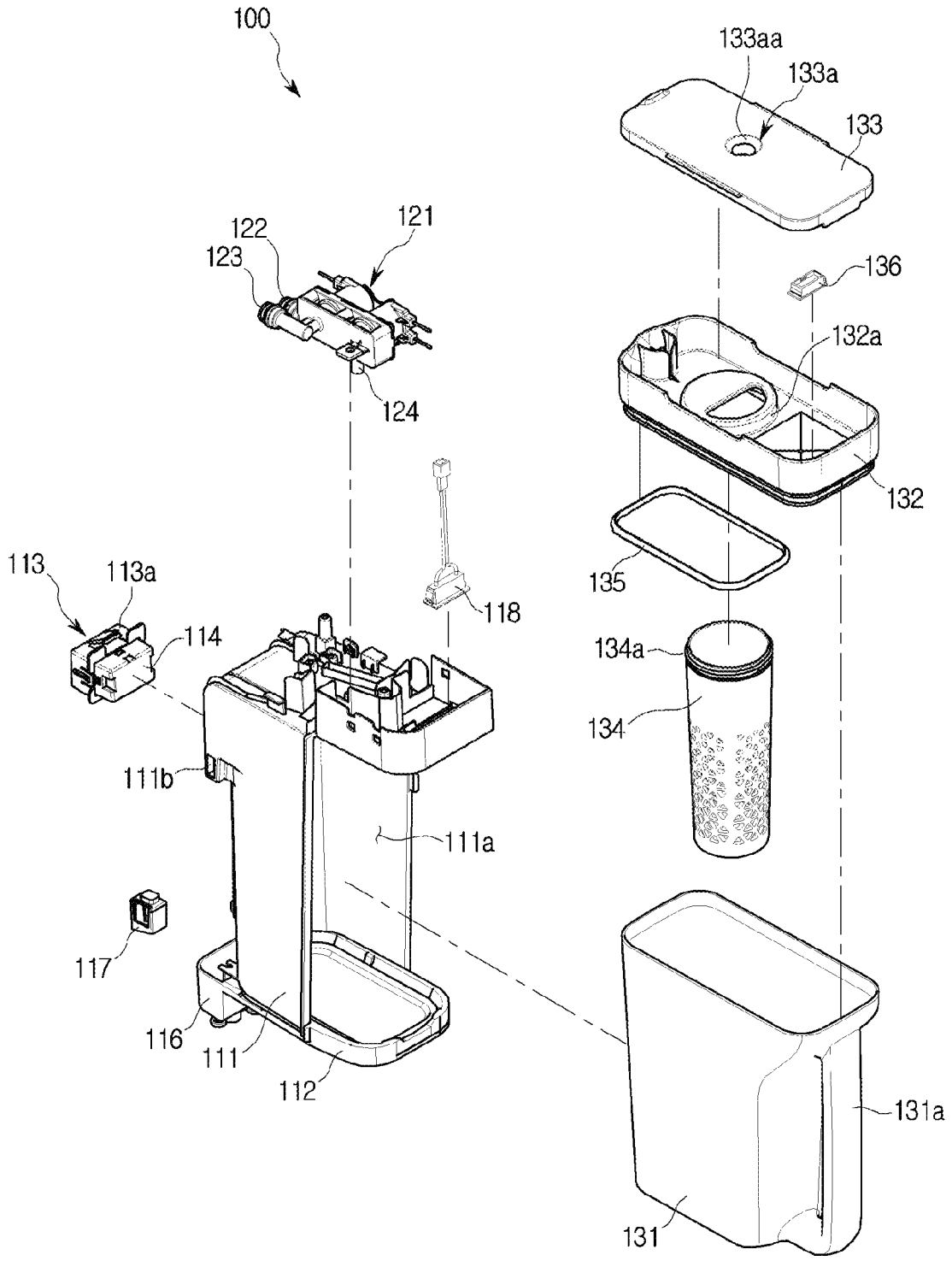
FIG. 7 is an exploded view illustrating the water tank assembly shown in FIG. 6.
Figure 8:
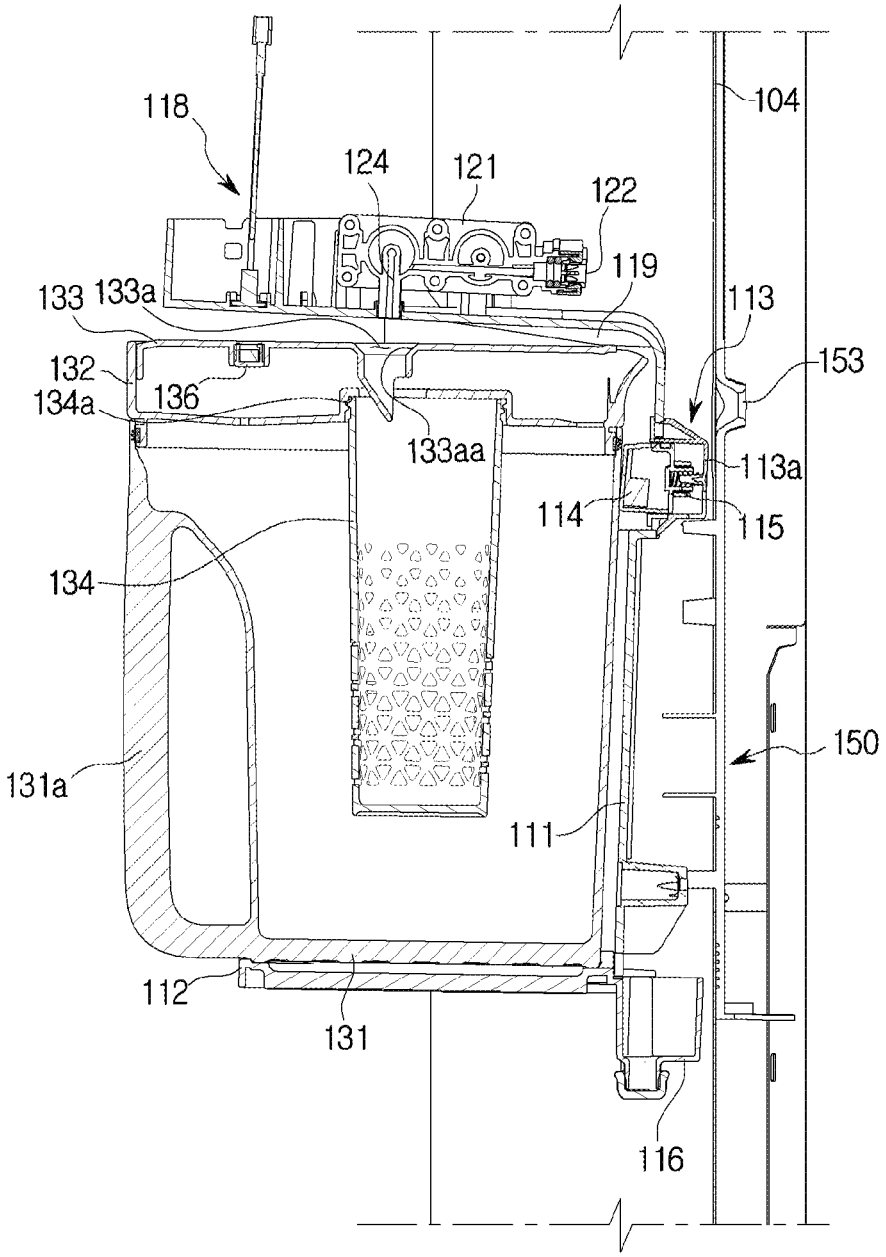
FIG. 8 is a side cross-sectional view illustrating a part of one of the doors of the refrigerator shown in FIG. 2.
Figure 9:
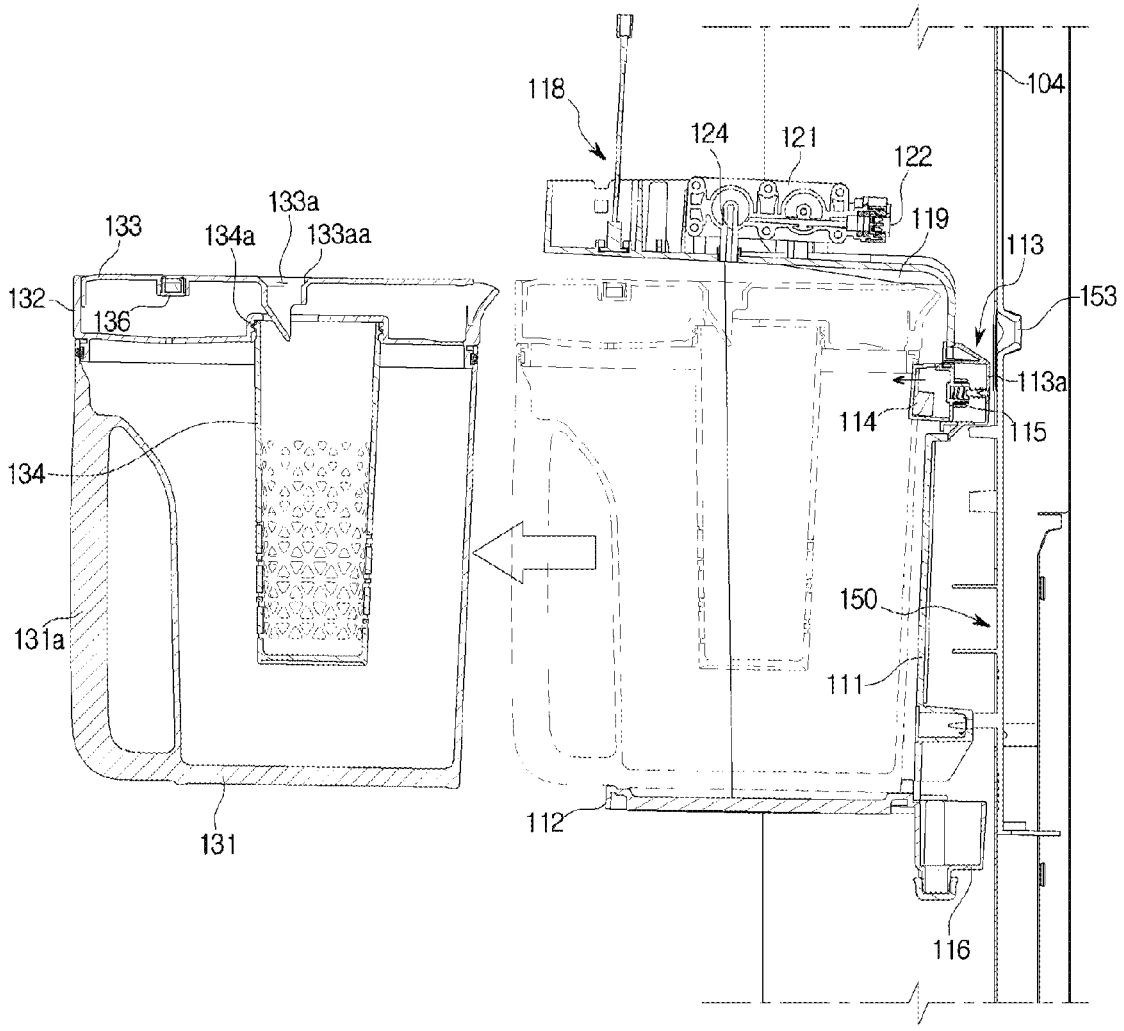
FIG. 9 is a side cross-sectional view illustrating a part of one of the doors of the refrigerator shown in FIG. 3.
Figure 10:
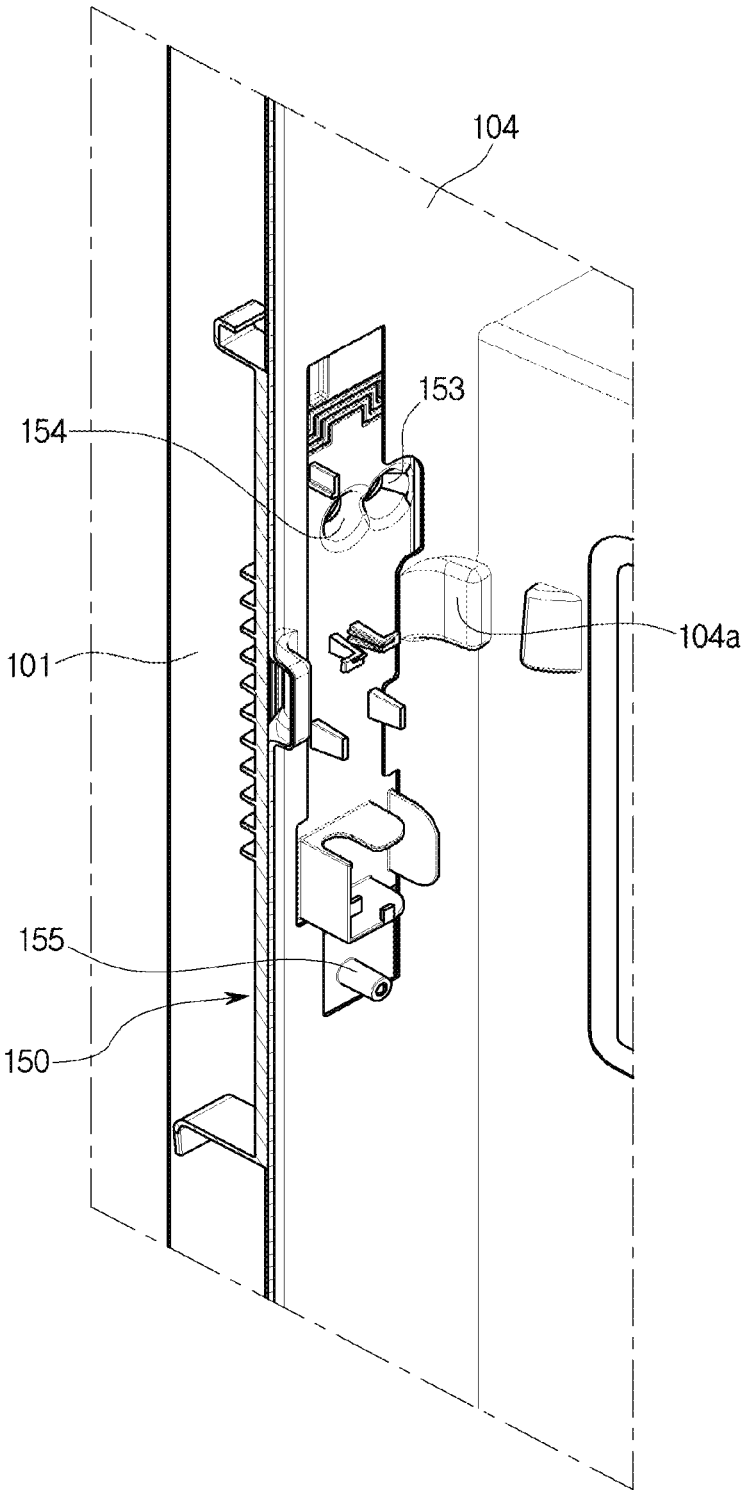
FIG. 10 is a cross-sectional view illustrating the water tank assembly mounted in a part of the door of the refrigerator shown in FIG. 2.
Figure 11:
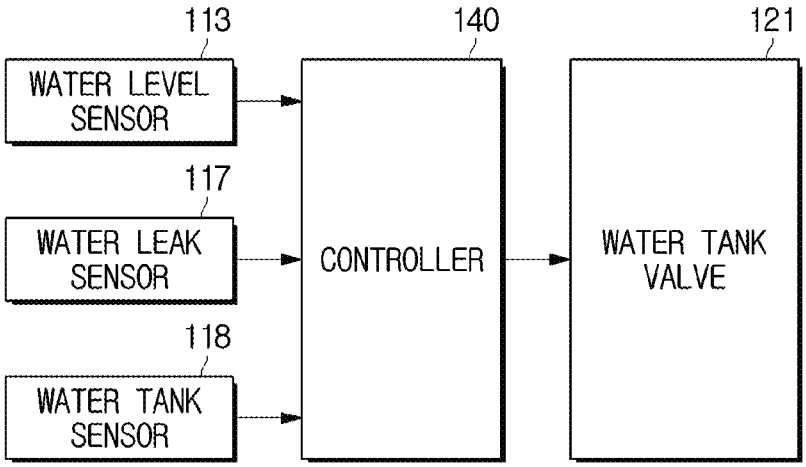
FIG. 11 is a block diagram illustrating a configuration for controlling the water tank assembly of the refrigerator shown in FIG. 2.

FIG. 5 is an exploded view illustrating one door 21 of the doors 21, 22, 31, and 41 and the water tank assembly 100 of the refrigerator 1 shown in FIG. 1. FIG. 6 is a view illustrating the water tank assembly 100 shown in FIG. 5. FIG. 7 is an exploded view illustrating the water tank assembly 100 shown in FIG. 6. FIG. 8 is a side cross-sectional view illustrating a part of the door 21 of the doors 21, 22, 31, and 41 of the refrigerator 1 shown in FIG. 2. FIG. 9 is a side cross-sectional view illustrating a part of the door 21 of the doors 21, 22, 31, and 41 of the refrigerator 1 shown in FIG. 3. FIG. 10 is a cross-sectional view illustrating a part of the door 21 in which the water tank assembly 100 of the refrigerator 1 shown in FIG. 2 is mounted. FIG. 11 is a block diagram illustrating a configuration for controlling the water tank assembly 100 of the refrigerator 1 shown in FIG. 2.

Referring to FIGS. 5 to 7, the door 21 of the refrigerator 1 according to one embodiment of the present disclosure may include a outer door casing 101 and an inner door casing 104. Hereinafter, although the door 21 coupled to a left side of the refrigerator compartment 20 will be described for convenience of description, components described below may be applied to the door 22 coupled to a right side of the refrigerator compartment 20 and may be applied to doors which open and close the freezer compartments 30 and 40.

The outer door casing 101 may form an external shape of door and may include a dispenser opening 102 in which the dispenser 90 is disposed. The outer door casing 101 may include a handle opening 103 in which the handle 21*a* is mounted. However, the handle 21*a*, as shown in FIG. 1, is not separately mounted and may be gripped by the user due to recesses formed in the outer door casing 101.

The inner door casing 104 is coupled to the outer door casing 101, and an insulator may be provided between the inner door casing 104 and the outer door casing 101. Accordingly, the refrigerator 1 may prevent a leakage of cold air through the door 21.

The inner door casing 104 may include a bracket opening 105 in which a door bracket 150, which will be described below, is mounted. The bracket opening 105 may be formed at a part of the inner door casing 104 in which the water tank assembly 100 is mounted in order to guide the water tank water supply flow path 75 extending from the storage tank assembly 70 to the water tank assembly 100.

The door bracket 150 may be mounted in the bracket opening 105 of the inner door casing 104. The door bracket 150 may be coupled to the inner door casing 104 before the insulator is provided in a space between the outer door casing 101 and the inner door casing 104. The door bracket 150 may fix a hose which forms the water tank water supply flow path 75 and fix a hose which forms a dispenser water supply flow path 99. The door bracket 150 may be formed by injection molding.

The door bracket 150 may include an inner casing coupler 151 coupled to the inner door casing 104 using a hooking method. The door bracket 150 may include a door support 152 which supports at least one portion of the inner door casing 104 and/or the outer door casing 101.

Referring to FIG. 10, the door bracket 150 may include a first flow path opening 153 through which the water tank water supply flow path 75 passes. The water tank water supply flow path 75 which passes through the first flow path opening 153 may be connected to the water tank valve 121 of the water tank assembly 100. The door bracket 150 may include a second flow path opening 154 through which the dispenser water supply flow path 99, which diverges from the water tank valve 121, passes. The dispenser water supply flow path 99 which passes through the second flow path opening 154 may extend to the water dispensing space 91 of the dispenser 90.

A first cover 106 and a second cover 107 mounted on a rear surface of the inner door casing 104, which faces the refrigerator compartment 20 when the refrigerator compartment 20 the door 21 has been closed, may be included.

The first cover 106 may be coupled to the inner door casing 104 to support one of the door guards 24. The second cover 107 may be coupled to the inner door casing 104 and may form a space which stores food. The second cover 107 may include a chute opening 94*a* which forms the chute 94.

The water tank assembly 100 may be separably mounted in the door 21. In detail, the water tank assembly 100 may be separably mounted in the inner door casing 104. The water tank assembly 100 may include a water tank case 110 disposed in the door 21 and a water tank 130 separably mounted in the water tank case 110.

The water tank case 110 may be separably mounted in the door 21. The water tank case 110 may include a case body 111 which forms a mounting portion 111*a* at which the water tank 130 is separably mounted. The case body 111 may include a door coupler 101*b* coupled to a case coupler 104*a* (refer to FIG. 10) of the inner door casing 104. The water tank case 110 may include a bracket coupler 101*c* coupled to a case coupler 155 of the door bracket 150. According to the configuration, the water tank case 110 and the door bracket 150 may be firmly mounted in the inner door casing 104.

The water tank case 110 may include a first support 112 which supports a bottom end of the water tank 130 in a direction in which the water tank 130 is mounted in the water tank case 110. The first support 112 may be provided to cover at least one portion of the bottom end of the water tank 130. That is, when the water tank 130 is mounted in the mounting portion 111*a* of the water tank case 110, the bottom end of the water tank 130 may be disposed to be covered by the first support 112. Accordingly, the water tank 130 does not deviate from the water tank case 110 even when the door 21 closes while the water tank 130 is mounted in the water tank case 110.

An inner surface of the mounting portion 111*a* of the water tank case 110 may include a second support 119 which supports a top end of the water tank 130 in a direction opposite to a pivoting direction in order to prevent the water tank 130 from pivoting on the bottom end of the water tank 130 supported by the first support 112 when the door 21 closes. The second support 119 protrudes downward from a top surface of an inside of the mounting portion 111*a* and may be formed to be tilted downward toward the front side.

Referring to FIG. 8, although the water tank 130 will pivot counterclockwise on the rear bottom end supported by the first support 112 when the door 21 closes, the second support 119 supports the front top end downward such that the water tank 130 may be prevented from pivoting.

According to the above configuration, when the water tank 130 is mounted in the water tank case 110, the first support 112 may support the rear bottom end of the water tank 130 and the second support 119 may support the front top end of the water tank 130. Accordingly, the refrigerator 1 may prevent the water tank 130 from being separated from the water tank case 110 when the door 21 closes.

A water level sensor 113 configured to sense a water level in the water tank 130 mounted in the water tank case 110 may be disposed in the water tank case 110. The water level sensor 113 may be disposed at a front end of the case body 111. However, a position of the water level sensor 113 is not limited thereto and may be disposed at any position capable of sensing the water level of the water tank 130.

The water level sensor 113 may be provided as a capacitance sensor capable of sensing a water level in the water tank 130 by sensing a capacitance which varies according to a level of a liquid in the water tank 130. In this case, the water level sensor 113 may sense the level of the liquid in the water tank 130 in contact with only the water tank 130.

For this, the water level sensor 113 may include a sensor bracket 113*a* fixed to the case body 111, a sensor 114 which senses the water level of the water tank 130, and an elastic member 115 which pressurizes the sensor 114 in a direction opposite to a direction in which the water tank 130 is mounted.

The sensor 114 may be disposed to come into contact with the water tank 130 when the water tank 130 is mounted in the water tank case 110. The sensor 114 may be provided to be movable with respect to the sensor bracket 113*a*. The sensor 114 may be provided to be movable forward and backward.

The elastic member 115 may be provided to pressurize the sensor 114 in a rearward direction. That is, the elastic member 115 may be provided to pressurize the sensor 114 in a direction in which the water tank 130 separates from the water tank case 110.

Referring to FIG. 8, when the water tank 130 is mounted in the water tank case 110 according to the configuration, since the sensor 114 moves into the sensor bracket 113*a* and is pressurized toward the water tank 130 by the elastic member 115, the sensor 114 may remain in a state of contact with the water tank 130. Accordingly, the sensor 114 may sense a water level of the water tank 130 by sensing a change in capacitance of the water tank 130.

On the other hand, referring to FIG. 9, when the water tank 130 separates from the water tank case 110, since the elastic member 115 pressurizes the sensor 114 in the direction in which the water tank 130 separates, the sensor 114 may be withdrawn from the sensor bracket 113*a*.

When a certain amount of water is stored in the water tank 130, the water level sensor 113 may transmit a signal for controlling the water tank valve 121 to a controller 140 to prevent water from being supplied to the water tank 130. On the other hand, when an amount of water stored in the water tank 130 is smaller than the certain amount, the water level sensor 113 may transmit a signal for controlling the water tank valve 121 to a controller 140 to supply water to the water tank 130.

Since the water level sensor 113 may sense a level of the water tank 130 without coming in direct contact with a liquid in the water tank, the water level sensor 113 may be provided in a relatively simple configuration and a relatively precise sensing result may be obtained.

According to the configuration, the refrigerator 1 according to one embodiment of the present disclosure may allow the water tank 130 to constantly have stored the certain amount of water. Accordingly, the refrigerator 1 may constantly provide an adequate amount of water to the user.

The water tank case 110 may include a leaked water tray 116 formed below the case body 111. The leaked water tray 116 may be disposed to collect water when the water is excessively supplied to the water tank 130 and flows over the water tank 130. The leaked water tray 116 may communicate with a bottom of the case body 111 through a water leak opening 116*a* formed at the bottom of the case body 111. The water which flows over the water tank 130 may be guided to the leaked water tray 116 through the water leak opening 116*a*.

A water leak sensor 117 which senses water collected in the leaked water tray 116 may be provided at the leaked water tray 116. When it is sensed that a certain amount of water has been collected in the leaked water tray 116, the water leak sensor 117 may transmit a signal for controlling the water tank valve 121 to the controller 140 to prevent water from being supplied to the water tank 130.

For example, the water leak sensor 117 is provided to generate a short circuit when water which leaks from the water tank 130 has been collected in the leaked water tray 116 such that the controller 140 may control the water tank valve 121 so that a flow path of the water tank valve 121 toward the water tank 130 is closed.

Accordingly, the refrigerator 1 according to one embodiment of the present disclosure may prevent malfunction of the refrigerator 1 by stopping water from being supplied to the water tank 130 when an excessive amount of water is supplied to the water tank 130 and overflows the water tank 130.

A water tank sensor 118 which checks whether the water tank 130 is properly mounted in the mounting portion 111*a* of the case body 111 may be provided at the water tank case 110. The water tank sensor 118 may be disposed at a top of the water tank case 110.

The water tank sensor 118 may be provided by using a hall sensor. For this, a magnet 136 may be provided at the water tank 130. The magnet 136 may be disposed at a position corresponding to the water tank sensor 118 when the water tank 130 is mounted in the water tank case 110. When the water tank sensor 118 is disposed at the top of the water tank case 110, the magnet 136 may be disposed at a top of the water tank 130.

The water tank sensor 118 may sense whether the water tank 130 is properly mounted in the water tank case 110 and may transmit a signal which controls the water tank valve 121 to the controller 140 to prevent water from being supplied to the water tank 130 when the water tank 130 is not properly mounted.

Accordingly, the refrigerator 1 according to one embodiment of the present disclosure may prevent water from being supplied to the water tank 130 when the water tank 130 is not properly mounted.

The water tank valve 121 may be disposed above the water tank case 110. The water tank valve 121 may be configured to guide water supplied from the external water supply source 79 to the dispenser 90 or the water tank 130. The water tank valve 121 may be provided by using a three-way valve. In detail, the water tank valve 121 may include a first inlet 122 connected to the water tank water supply flow path 75, a first outlet 123 which forms a flow path for supplying water toward the dispenser 90, and a second outlet 124 which forms a flow path for supplying water to the water tank 130. The first outlet 123 and the second outlet 124 may be selectively opened and closed. A hose connected to the first inlet 122 and a hose connected to the first outlet 123 may pass through the door bracket 150.

The water tank valve 121 may be configured to prevent water from being supplied to the water tank 130 when the water level sensor 113 senses that a certain amount of water is stored in the water tank 130. On the other hand, the water tank valve 121 may be configured to supply water to the water tank 130 when the water level sensor 113 senses that a certain amount of water is not stored in the water tank 130. That is, the water tank valve 121 may be configured to open and close a flow path toward the water tank 130 depending on a water level of the water tank 130 sensed by the water level sensor 113.

The water tank valve 121 may be configured to prevent water from being supplied to the water tank 130 when the water leak sensor 117 senses that a certain amount of water has been collected in the leaked water tray 116. That is, the water tank valve 121 may be configured to supply water to the water tank 130 only when the water leak sensor 117 senses that a water is not leaking from the water tank 130.

The water tank valve 121 may be configured to cut off water supply to the water tank 130 when the water tank sensor 118 senses that the water tank 130 is not mounted normally in the water tank case 110. That is, the water tank valve 121 may be configured to supply water to the water tank 130 only when the water tank 130 is mounted normally in the water tank case 110.

The water tank valve 121 may be configured to supply water through the dispenser 90 by opening the flow path of the first outlet 123 which faces the dispenser 90 when a certain signal is input to the operating lever 93.

An outlet hole of the second outlet 124 of the water tank valve 121 may be provided to face a lower side on which the water tank 130 is disposed. When the water tank 130 is mounted in the water tank case 110, the outlet hole of the second outlet 124 may be disposed above a water tank inlet hole 133*a* of the water tank 130.

The outlet hole of the second outlet 124 and the water tank inlet hole 133*a* of the water tank 130 are disposed to be spaced apart without an additional connecting member such that water supplied through the second outlet 124 flows into the water tank inlet hole 133*a* in a direction of gravity. Here, to prevent the water which flows into the water tank inlet hole 133*a* from being dispersed, the outlet hole of the second outlet 124 may be provided in a size smaller than the water tank inlet hole 133*a*.

In addition, the water tank inlet hole 133*a* may include a guide 133*aa* for guiding water discharged through the outlet hole of the second outlet 124 to the inside of the water tank 130. The guide 133*aa* may be formed to be tilted and to have a diameter which gradually decreases from top to bottom. Most of the water supplied to the water tank 130 through the second outlet 124 may be guided to the water tank 130 by the guide 133*aa* without loss.

The water tank 130 may be separably mounted in the mounting portion 111*a* of the water tank case 110. The water tank 130 may include a body 131 and covers 132 and 133.

The body 131 may store a certain amount of water. A maximum storage amount of the body 131 may be referred to as a full level amount. The body 131 may include a water tank handle 131*a* formed to be easily gripped by the user and to be separable from the water tank case 110. The body 131 may be configured to include a transparent material to check water stored therein.

The covers 132 and 133 cover a top of the body 131 and may include a first cover 132 and a second cover 133.

The first cover 132 may be coupled to the top of the body 131, and in detail, may be coupled to the body 131 through force fitting. A sealing member 135 for preventing or reducing a leakage of the water stored in the body 131 may be provided between the body 131 and the first cover 132. The sealing member 135 may seal a space between the body 131 and the first cover 132. The sealing member 135 may be configured to include an elastic material such as a rubber.

The first cover 132 may include an infuser coupler 132*a* formed to allow an infuser 134 to be coupled thereto. The infuser coupler 132*a* may include a screw thread formed on an inner surface thereof. Accordingly, the first cover 132 may be coupled to the infuser 134 through a screw-coupling method.

The magnet 136 may be disposed in the first cover 132. The magnet 136 may be disposed at a position corresponding to the water tank sensor 118 when the water tank 130 is mounted in the water tank case 110.

The second cover 133 may be coupled to a top of the first cover 132. The second cover 133 may include the water tank inlet hole 133*a* formed at a top surface of the second cover 133 while disposed at a position corresponding to the outlet hole of the second outlet 124 when the water tank 130 is mounted in the water tank case 110. The water tank inlet hole 133*a* may include the guide 133*aa* for guiding water discharged from the second outlet 124 to the inside of the water tank 130.

The infuser 134 may be provided in the water tank 130. The infuser 134 may be separably coupled to the first cover 132. The user may receive, through the infuser 134, water in which tea is infused.

Figure 12:
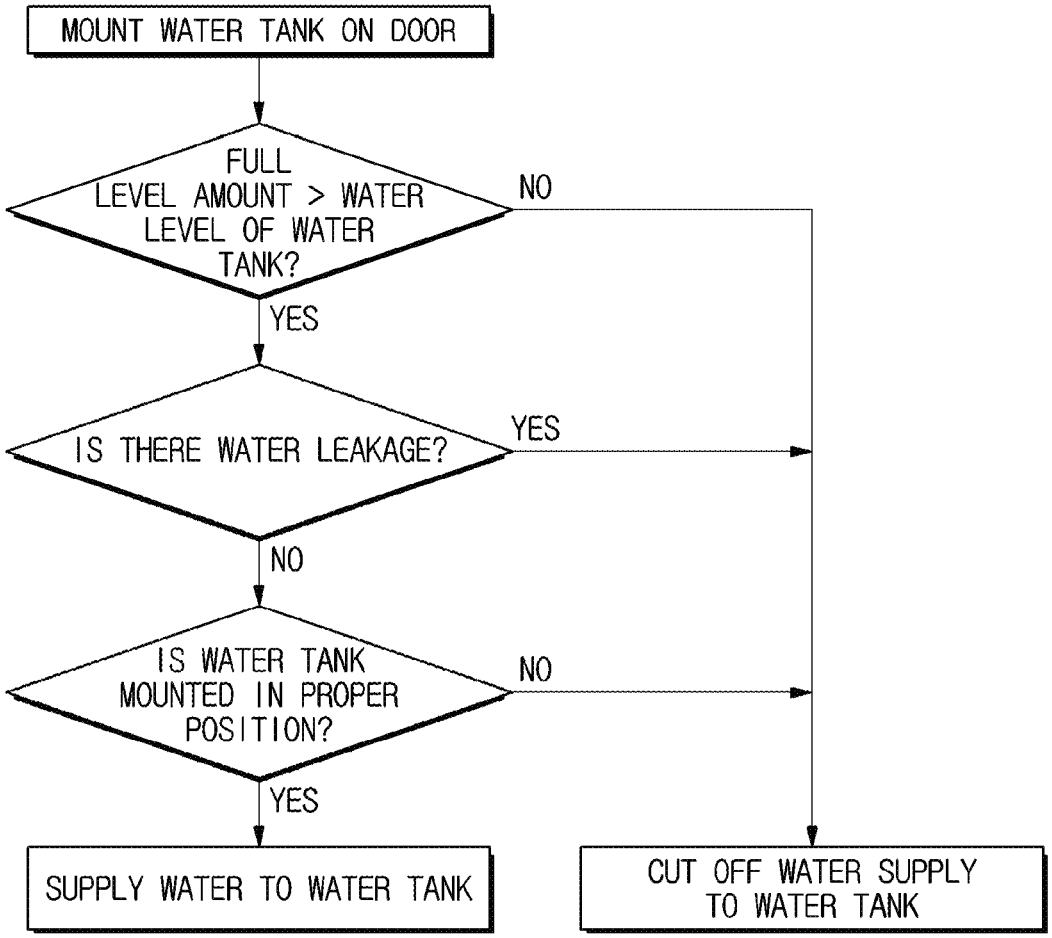
FIG. 12 is a flowchart illustrating a method of controlling water supply to the water tank of the water tank assembly of the refrigerator shown in FIG. 2.

FIG. 12 is a flowchart illustrating a method of controlling water supply to the water tank 130 of the water tank assembly 100 of the refrigerator 1 shown in FIG. 2.

First, the user may mount the water tank 130 in the water tank case 110 provided at the door 21. When the water tank 130 is mounted in the water tank case 110, the water level sensor 113 senses a water level of the water tank 130 and transmits sensed water level information to the controller 140. The controller 140 may selectively supply water to the water tank 130 according to the water level information of the water tank 130 received from the water level sensor 113.

In detail, the controller 140 compares the water level of the water tank 130 received from the water level sensor 113 with a full level amount, prestored, of the water tank 130. Here, when the water level of the water tank 130 is the full level amount or higher, the controller 140 may stop water from being supplied to the water tank 130 by controlling the water tank valve 121. Afterward, the controller 140 may not supply water to the water tank 130 unless the water tank 130 is separated from the water tank case 110 and is mounted again thereon.

On the other hand, when the water level of the water tank 130 is less than the full level amount, the water leak sensor 117 checks whether a water leakage has occurred at the water tank 130. In detail, the water leak sensor 117 checks whether leaked water has been collected in the leaked water tray 116. Here, when it is sensed that the water has been leaking from the water tank 130, the controller 140 may stop water from being supplied to the water tank 130 by controlling the water tank valve 121.

On the other hand, when there is no water leakage from the water tank 130, it is checked whether the water tank sensor 118 is mounted in a proper position at the water tank 130. Here, when it is checked that the water tank 130 is not mounted in the proper position at the water tank case 110, the controller 140 may stop water from being supplied to the water tank 130 by controlling the water tank valve 121.

On the other hand, when it is sensed that the water tank 130 is mounted in the proper position, the controller 140 may supply water to the water tank 130 by controlling the water tank valve 121.

In addition, the controller 140 may prevent more water than that of the full level amount from being supplied to the water tank 130 by controlling the water tank valve 121 on the basis of a prestored maximum amount of time of water supply to the water tank 130.

According to the above configuration, the refrigerator 1 according to one embodiment of the present disclosure may provide an adequate amount of water to the user even through the user does not perform additional manipulation. Also, the refrigerator 1 may prevent a malfunction of supplying a larger amount of water than the full level amount to the water tank 130.

Figure 13:
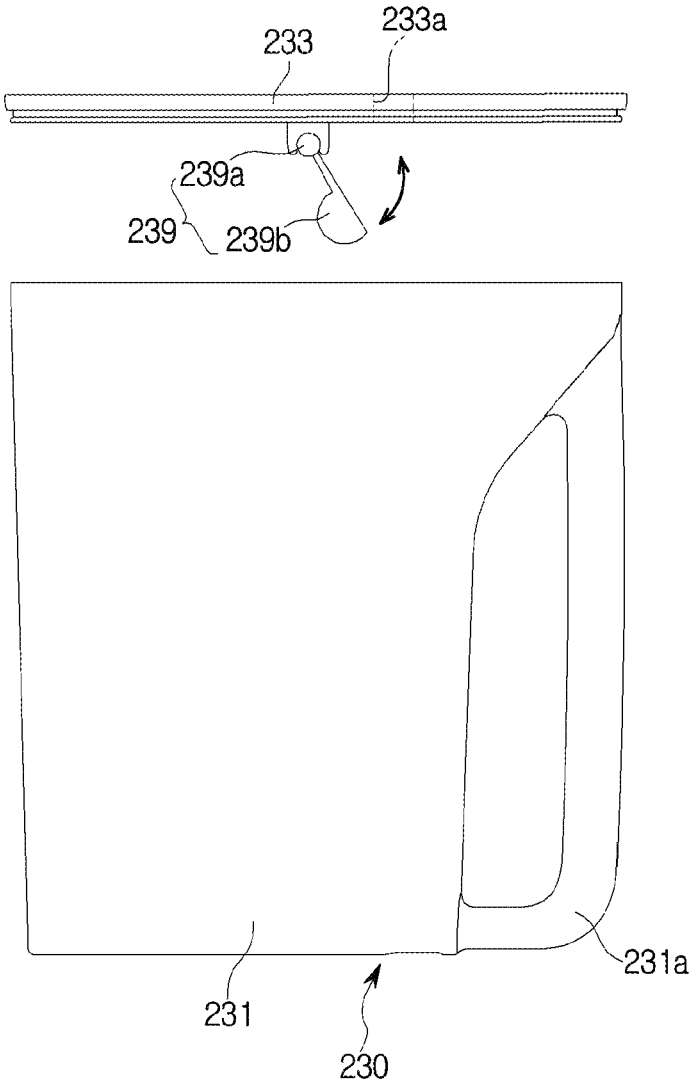
FIG. 13 is a view illustrating another example of the water tank shown in FIG. 5.

FIG. 13 is a view illustrating another example of the water tank shown in FIG. 5.

A water tank 230 according to another embodiment of the present disclosure will be described with reference to FIG. 13. However, components identical to those of the embodiment shown in FIGS. 5 to 7 will be referred to using the same reference numerals and a description thereof may be omitted.

The water tank 230 according to another embodiment of the present disclosure may include a flow sensor 239 for preventing or reducing a larger amount of water than a full level amount from being supplied to a body 231 at which a water tank handle 231*a* is provided.

The flow sensor 239 may include an opening and closing member 239*b* provided to be pivotable on a pivot 239*a*. The flow sensor 239 may be pivotably mounted on a bottom of a cover 233. The opening and closing member 239*b* may be configured to include a floatable material.

The flow sensor 239 according to the above configuration may close a water tank inlet hole 233*a* of the cover 233 when a full level amount of water has been supplied to the body 231. In detail, when the full level amount of water has been supplied to the body 231, the flow sensor 239 may float while pivoting on the pivot 239*a* counterclockwise according to an increase in the level of the supplied water. The opening and closing member 239*b* may float so as to be able to close the water tank inlet hole 233*a* such that water may stop being supplied to the body 231 of the water tank 230.

As is apparent from the above description, a refrigerator in accordance with one embodiment of the present disclosure senses a water level of a water tank through a water level sensor and controls a water tank valve to allow the water tank to constantly have stored a certain amount of water such that user convenience in using water may be increased.

A refrigerator in accordance with one embodiment of the present disclosure senses water leakage from a water tank through a water leak sensor and prevents water from being supplied to the water tank such that water may be prevented from being oversupplied to the water tank.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A refrigerator comprising:

a body including a storage compartment;

a door that opens or closes the storage compartment and comprises a dispenser;

a water tank case disposed in the door;

a water tank separably mounted in the water tank case;

a water level sensor configured to sense a water level inside the water tank when the water tank is mounted in the water tank case; and a water tank valve configured to supply water to the dispenser or the water tank, wherein the water level sensor comprises:

a sensor provided to move in a first direction in contact with the water tank when the water tank is mounted to the water tank case; and an elastic member that pressurizes the sensor in a second direction opposite to the first direction, and wherein the water tank valve is configured to block water from being supplied to the water tank when the water level sensor senses that a certain amount of water is stored in the water tank.

2. The refrigerator of claim 1, wherein the water tank case is separably mounted in the door.

3. The refrigerator of claim 1, wherein the water level sensor is configured to sense the water level inside the water tank by sensing a capacitance change according to a water level of a liquid in the water tank.

4. The refrigerator of claim 1, further comprising a water purifying filter disposed in a flow path between a water supply source and the water tank valve and configured to purify water supplied from the water supply source.

5. The refrigerator of claim 1, wherein the water tank valve is configured to supply water to the water tank when the water level sensor senses that a certain amount of water is not present in the water tank.

6. The refrigerator of claim 1, wherein the dispenser comprises an operating lever exposed to an outside of the door, and the water tank valve is configured to supply the water through the dispenser by opening a flow path that faces the dispenser when a signal is input to the operating lever.

7. The refrigerator of claim 1, wherein:

the water tank case comprises:

a leaked water tray provided below the water tank case; and a water leak sensor configured to sense water collected in the leaked water tray, and the water tank valve is configured to cut off a water supply to the water tank when the water leak sensor senses that a certain amount of water has been collected in the leaked water tray.

8. The refrigerator of claim 1, wherein the water tank case comprises a first support that supports a portion of the water tank in a direction in that the water tank is mounted in the water tank case.

9. The refrigerator of claim 8, wherein the water tank case comprises a second support that supports another portion of the water tank in a direction opposite to a pivoting direction to prevent the water tank from pivoting on the portion of the water tank supported by the first support when the door closes.

10. The refrigerator of claim 8, wherein the first support is provided to cover at least a portion of a bottom end of the water tank.

11. The refrigerator of claim 1, wherein:

the water tank valve is disposed at a top of the water tank case such that an outlet hole through that water supplied to the water tank is discharged faces downward, and the water tank comprises:

a body;

a cover that covers a top of the body; and a water tank inlet hole formed at a top surface of the cover and disposed at a position corresponding to the outlet hole when the water tank is mounted in the water tank case.

12. The refrigerator of claim 11, wherein the water tank inlet hole has a size greater than that of the outlet hole.

13. The refrigerator of claim 1, wherein the water tank comprises:

a body;

a cover that covers a top of the body; and an infuser separably coupled to the cover and disposed in the body when the cover is coupled to the body.

14. The refrigerator of claim 1, wherein the water tank case comprises a water tank sensor configured to sense whether the water tank is mounted.

* * * * *